US005584243A

United States Patent [19]

Kern

[11] Patent Number: 5,584,243

[45] Date of Patent: Dec. 17, 1996

[54] CONVERSION KIT FOR A GRAVURE PRINTING UNIT

[75] Inventor: Walter J. Kern, North Scituate, R.I.

[73] Assignee: Austrian Machine Corporation, Cranston, R.I.

[21] Appl. No.: 583,716

[22] Filed: Jan. 5, 1996

[51] Int. Cl.[6] ..... B41F 1/34

[52] U.S. Cl. ..... 101/479; 101/57; 101/169; 101/350; 101/365

[58] Field of Search ..... 101/479, 216, 101/219, 157, 169, 207, 208, 348, 349, 350, 365, 367

[56] References Cited

U.S. PATENT DOCUMENTS

| | | | |
|---|---|---|---|
| 2,479,023 | 8/1949 | Peyrebrune et al. | 101/216 |
| 3,470,816 | 10/1969 | Piecha et al. | 101/216 |
| 4,026,210 | 5/1977 | Merzagora | 101/169 |
| 4,137,843 | 2/1979 | Ottenhue | 101/216 |
| 5,060,569 | 9/1991 | Gladow | 101/216 |
| 5,136,941 | 8/1992 | Lübke et al. | 101/157 |
| 5,224,424 | 7/1993 | Layland | 101/169 |
| 5,481,972 | 1/1996 | Schmid | 101/216 |
| 5,522,316 | 6/1996 | Singler | 101/479 |
| 5,528,986 | 6/1996 | Andersson et al. | 101/219 |

*Primary Examiner*—Eugene H. Eickholt
*Attorney, Agent, or Firm*—Salter & Michaelson

[57] ABSTRACT

The conversion kit includes a pair of side frame mounting plates, one for each side frame of an older printing unit, wherein the mounting plates are mounted on the inwardly facing surfaces of their respective side frames after a cylinder, an ink fountain, and a doctor blade assembly of the printing unit are removed therefrom. The kit also includes a new ink fountain having an ink well positioned beneath the cylinder, and a sock roll for smoothing out ink on the cylinder and for impregnating engraved cells formed therein with ink. The ink fountain is mounted on and supported by the mounting plates. Also provided is an adjustable doctor blade assembly which is mounted on the mounting plates, the assembly having a doctor blade, and an actuating device for moving the doctor blade towards and away from the cylinder. The arrangement is such that by virtue of the adjustability of the doctor blade, the side frames of the printing unit can receive cylinders having various circumferences, wherein the new ink fountain and adjustable doctor blade assembly are mounted directly on the pair of side frame mounting plates and function as a self-contained unit.

9 Claims, 6 Drawing Sheets

CONVERSION KIT FOR A GRAVURE PRINTING UNIT

BACKGROUND OF THE INVENTION

This invention relates generally to gravure printing units, and more particularly to a conversion kit for converting a doctor blade assembly and an ink fountain of a gravure printing unit.

In the art of gravure printing, gravure printing units have the following components: namely, a frame structure, an image carrier having a cylinder, an ink fountain positioned below the cylinder, a doctor blade assembly for wiping excess ink from the cylinder, and an impression roller which holds a web to be imaged against the cylinder. The frame structure includes two side frames which are adapted to fixedly mount therebetween the ink fountain, doctor blade assembly, and the impression roller. The image carrier comprises a cylinder which is engraved with the image to be printed or transferred, and depending upon the length of the image to be printed, can embody many different diameters. Stated another way, there are occasions requiring the cylinder to have a circumference anywhere from thirty inches to sixty inches, for example, for accommodating different run lengths. In order to accommodate cylinders having varying diameters, it is imperative that the doctor blade assembly have a wide range of motion towards and away from the cylinder so that it can effectively wipe the cylinders of excess ink.

Older models of gravure printing units, such as those manufactured in the 1950s, have stationary doctor blade assemblies which accommodate only one size of a printing cylinder, or doctor blade assemblies having only a limited range of motion for receiving cylinders having substantially similar circumferences (e.g., between thirty and thirty-five inches). Such units therefore are only capable of running articles having limited lengths. In today's market, where variety is extremely important, these older printing units are largely outdated and ineffective. Thus, most printing companies are forced to purchase relatively expensive new equipment and scrap their older equipment even though it may still be in good shape and produce adequate results.

The foregoing illustrates limitations known to exist in present printing units having stationary doctor blade assemblies and/or doctor blade assemblies with a limited range of motion, and those printing units having older, outdated component parts. Thus, it is apparent that it would be advantageous to provide an alternative directed to overcoming one or more of the limitations set forth above. Accordingly, a suitable alternative is provided including features more fully disclosed hereinafter.

Among the several objects of the present invention are the provision of a conversion kit which is capable of converting a printing unit having a stationary doctor blade assembly or a doctor blade assembly having limited range of motion, to a unit having a movable doctor blade assembly; the provision of such a conversion kit which gives the printing unit the ability to accommodate printing cylinders having varying diameters; the provision of such a conversion kit which is easy to install and economizes important, expensive parts, such as the side frames of the printing unit; the provision of such a conversion kit which updates and modernizes some of the component parts of the printing unit which are old and outdated; and the provision of such a conversion kit which is relatively inexpensive to install and extends the life of the present printing unit.

In general, the present invention is directed to a conversion kit for converting a doctor blade assembly and an ink fountain of a printing unit wherein the printing unit is of the type for depositing ink on a substrate, such as a web of paper, and comprises a pair of spaced apart side frames, and an image carrier having a cylinder engraved with the image to be printed on the substrate. The cylinder is removably and rotatably mounted on the side frames, and is disposed within an ink fountain having an ink well positioned beneath the cylinder, and means for depositing ink on the cylinder. The ink fountain is also supported by the side frames. A doctor blade assembly is mounted on the side frames, and has a blade which wipes excess ink from non-image areas of the cylinder. The doctor blade assembly is stationary and/or has a limited range of motion, and therefore can accommodate cylinder bodies having a specific circumference or limited range of circumferences (e.g., thirty to thirty-five inches). The printing unit further includes an impression roller which holds the substrate to be printed against the cylinder to obtain ink transfer, the impression roller also being rotatably mounted on the side frames.

The conversion kit of the present invention comprises a pair of side frame mounting plates, one for each side frame, wherein the mounting plates are mounted on the inwardly facing surfaces of their respective side frames after the cylinder, ink fountain, and doctor blade assembly are removed therefrom. The kit also includes a new ink fountain having an ink well positioned beneath the cylinder, and means for depositing ink on the cylinder. The ink fountain is mounted on and supported by the mounting plates. Also provided is an adjustable doctor blade assembly mounted on the mounting plates, the adjustable doctor blade assembly having a doctor blade, and means for moving the doctor blade towards and away from the cylinder. The arrangement is such that by virtue of the adjustability of the doctor blade, the side frames of the printing unit can receive cylinders having various circumferences, wherein the new ink fountain and adjustable doctor blade assembly are mounted directly on the pair of side frame mounting plates and function as a self-contained unit.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

Corresponding reference numerals designate corresponding parts throughout the several views of the drawings.

DETAILED DESCRIPTION OF THE PREFERRED EMBODIMENTS

Figure 1:
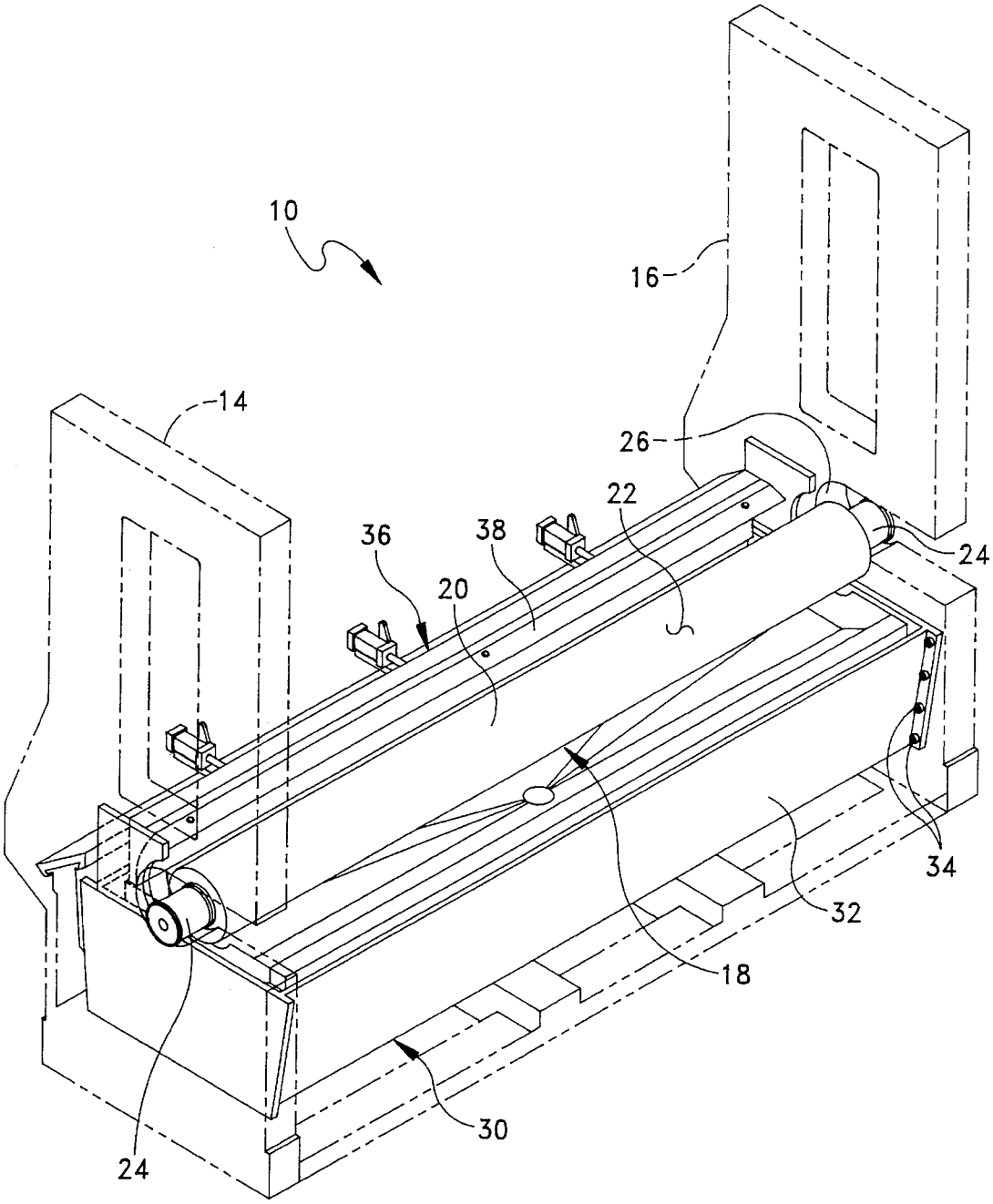
FIG. 1 is a perspective view of a printing unit having a stationary doctor blade assembly and an outdated ink fountain, the printing unit having side frames which are illustrated in broken lines.

Referring now to the drawings, and more particularly to FIG. 1, there is generally indicated at 10 a gravure printing unit which is capable of imaging ink onto a substrate (not shown), such as a web of paper, that passes therethrough. The printing unit 10 is of an older make wherein its internal components are limited and largely outdated relative to the abilities of more modern printing units which are commercially available. A conversion kit, generally indicated at 12 in FIG. 2, of the present invention is directed to replacing these internal components of the printing unit 10 for increasing the versatility of the older printing unit and for updating and modernizing the internal components thereof.

The printing unit 10 illustrated in FIG. 1 is well-known in the art, and has a pair of spaced apart side frames 14, 16 which support the internal components of the unit 10. The side frames 14, 16 are fabricated from cast iron or steel and have a thickness between three and five inches. The reason for the substantial thickness of the side frames 14, 16 is that they must be able support the weight of the internal components of the printing unit 10 which are mounted thereon, along with the dynamic and centrifugal forces caused by the unit's moving and rotating components. It should be understood that there are a plurality of parts and accessories which are mounted on the side frames 14, 16 of the printing unit 10 which will not be disclosed or described herein since they are not concerned with the conversion kit 12 of the present invention. As can be well imagined, the side frames 14, 16 are costly to manufacture due to the amount of material required and the dimensional tolerances which must be accurate. Also, the side frames 14, 16 are difficult to set-up with the other components of the printing press wherein the separate printing units, dryer, folder, etc., must be in registry and aligned with one another.

Still referring to FIG. 1, the printing unit 10 further includes an image carrier, generally indicated at 18, having a cylinder body 20 with a surface 22 which is engraved with the image to be printed on the substrate. As shown, the cylinder body 20 has opposite ends (not designated) terminating in shaft portions, each shaft portion having a bearing structure 24 (e.g., a roller bearing) mounted thereon which is received within a large notch 26 formed in its respective side frame 14 and 16. This arrangement allows the image carrier 18 to be removed from the side frames 14, 16 while allowing for the rotation of the cylinder body 20 with respect to the side frames. Modern cylinder bodies have a copper surface covered with a thin chrome layer wherein the copper carries the engraved image and the chrome layer protects it. Of course, there are other ways to form the image onto the cylinder body but this is one of the more preferential. Ink is contained within the cells formed by the engraving process, and the substrate is positioned so that it engages the cylinder body for transferring the image onto the substrate. For each run, a different image carrier must be used for carrying the image to be transferred onto the substrate. Old image carriers are stripped and re-coated with copper and chrome for re-use.

Thus, it is important that the image carrier 18 be removable from the side frames 14, 16 of the printing unit 10 for its replacement between different printing runs. Older printing units, such as the one illustrated in FIG. 1, are capable of receiving cylinder bodies having only one specific, predetermined diameter (circumference), and if they are capable of receiving cylinder bodies having varying diameters, they are extremely limited (e.g., capable of receiving cylinder bodies having circumferences ranging between thirty and thirty-five inches). The conversion kit 12 is adapted to increase the versatility of these older printing units so that they can receive smaller and larger diameter cylinder bodies, while modernizing the components of the units.

Figure 6:
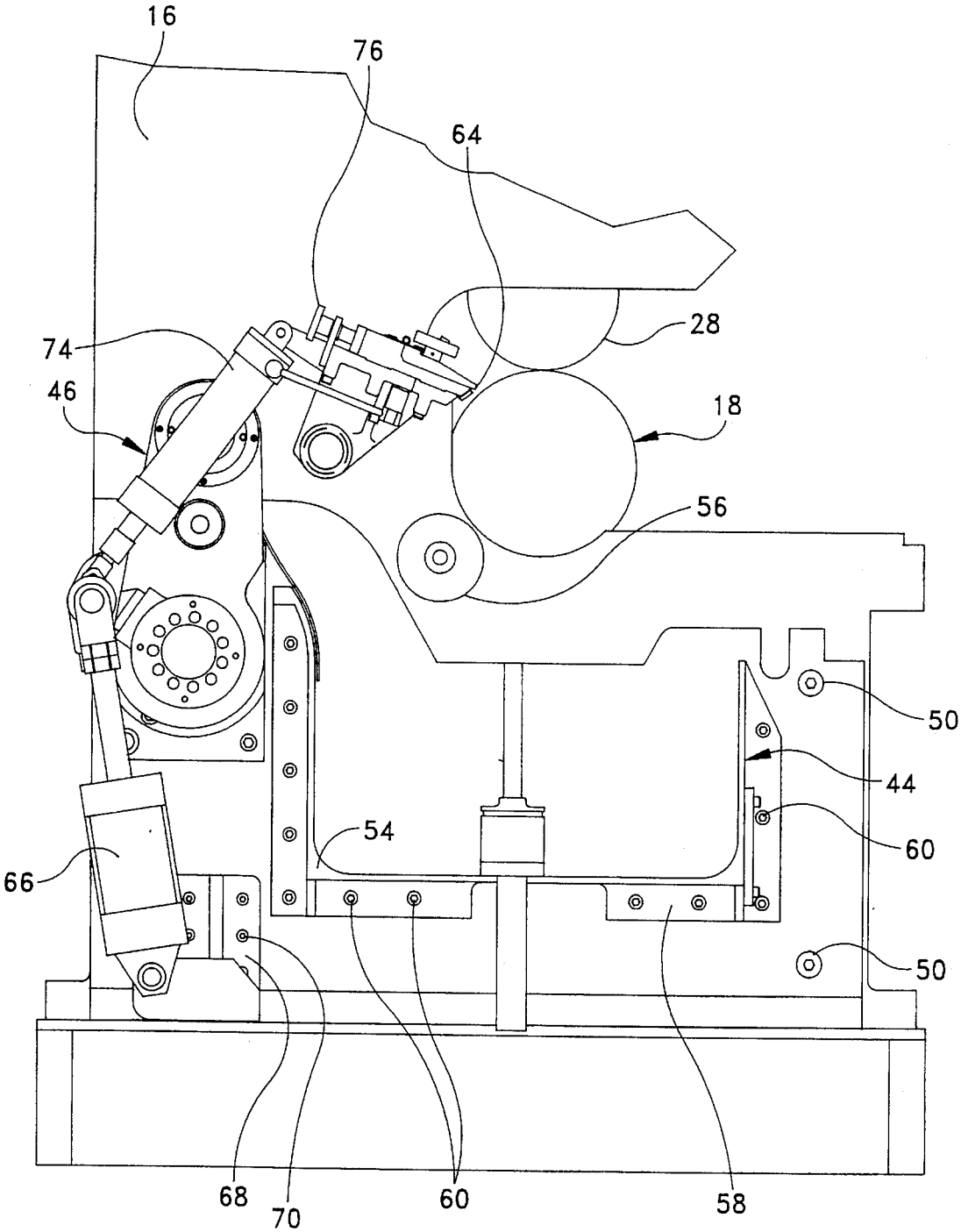
FIG. 6 is an end view thereof.

An impression roller is mounted on the side frames 14, 16 above the image carrier 18 for holding the substrate to be printed against the cylinder body 20 to obtain ink transfer between the cylinder body 20 and the substrate. The impression roller is not illustrated in FIGS. 1 and 2 for purposes of clarity; however, it is illustrated in FIG. 6 and indicated at 28. The impression roller 28 provides a nip point between the substrate and the cylinder body 20 so that the image is transferred cleanly and efficiently from the image carrier 18 to the substrate. Suitable brackets and bearings mount the impression roller 28 on the side frames 14, 16 of the printing unit 10 and enable it to move vertically up and down for clearance purposes when replacing or threading the web therebetween. This construction is also well-known in the art. It should be noted that almost all printing units, even those older units on which the conversion kit 12 of the present invention is applied, have impression rollers which are capable of moving vertically towards and away from the cylinder body of the image carrier for allowing the web-up of the printing unit.

The printing unit 10 also includes an ink fountain, generally indicated at 30, having an ink well 32 positioned beneath the cylindrical body 20 of the image carrier 18, and means embodying a sock roll (not shown in FIG. 1) for smoothing out the ink disposed on the cylinder body 20 from the ink well 32. As shown, the ink well 32 is bolted onto the side frames 14, 16 of the printing unit 10 by machine bolts 34, there being tapped openings (not shown) formed in the side frames 14, 16 for achieving this function. The arrangement is such that the cylinder body 20 extends into the ink well 32 and is bathed in ink provided in the ink well 32 whereby the ink remaining on the cylinder body 20 in the ink cells is smoothed out by the sock roll if provided. Due to the limited range of cylinder body 20 diameters received by the pre-modified unit 10, the sock roll has a limited range of motion for engaging the cylinder body 20. This method of transferring ink from the ink fountain 30 to the image carrier 18 is also well-known. It should be pointed out that there are also provided a plurality of ink guards (not shown) which prevent splattering ink caused by the high-speed rotation of the cylinder body 20 and sock roll from contaminating other components of the printing unit 10 and the substrate.

Still referring to FIG. 1, there is generally indicated at 36 a doctor blade assembly which is mounted on the side frames 14, 16. The doctor blade assembly 36 has a doctor blade 38 which wipes excess ink from the non-image areas of the cylinder body 20 of the image carrier 18. Since the unit 10 is capable of receiving cylinder bodies having a specified circumference, or a very limited range of circumferences, the doctor blade assembly 36 is substantially stationary and/or has a very limited range of motion towards and away from the cylinder body 20. Thus, in most instances the only adjustability of the doctor blade 38 is to vary the engagement pressure of the blade 38 on the cylinder body 20. As with most doctor blade assemblies, the one illustrated in FIG. 1 has suitable means for oscillating the doctor blade 38 (not shown) in the manner well-known in the art for preventing excess wear of the doctor blade 38 and the cylinder body 20. It should be pointed out that the arrangement shown in FIG. 1 illustrates the doctor blade 38 spaced from the cylinder body 20 of the image carrier 18 for illustration purposes. In use, the blade 38 engages the cylinder body 20 of the image carrier 18.

As stated briefly above, the conversion kit 12 of the present invention is designed to replace several of the internal components of the printing unit 10 for enabling it to accommodate image carriers having cylinder bodies with circumferences ranging from thirty to sixty inches, and for updating and modernizing some of the other component parts of the printing unit 10. Referring now to FIGS. 2–7, and more particularly to FIG. 2, the conversion kit 12 is a self-contained unit that comprises a pair of side frame mounting plates, generally indicated at 40, 42, a new ink fountain, generally indicated at 44, and an adjustable doctor blade assembly, generally indicated at 46. It should be pointed out that these parts of the conversion kit 12 can only be employed and mounted on the side frames 14, 16 after the existing ink fountain 30, doctor blade assembly 36, ink guards, and the like are removed from the side frames 14, 16 of the printing unit 10. One of the primary advantages of the conversion kit 12 of the present invention is that the side frames 14, 16 are preserved thereby saving time and money required to provide and install new, costly side frames.

Figure 3:
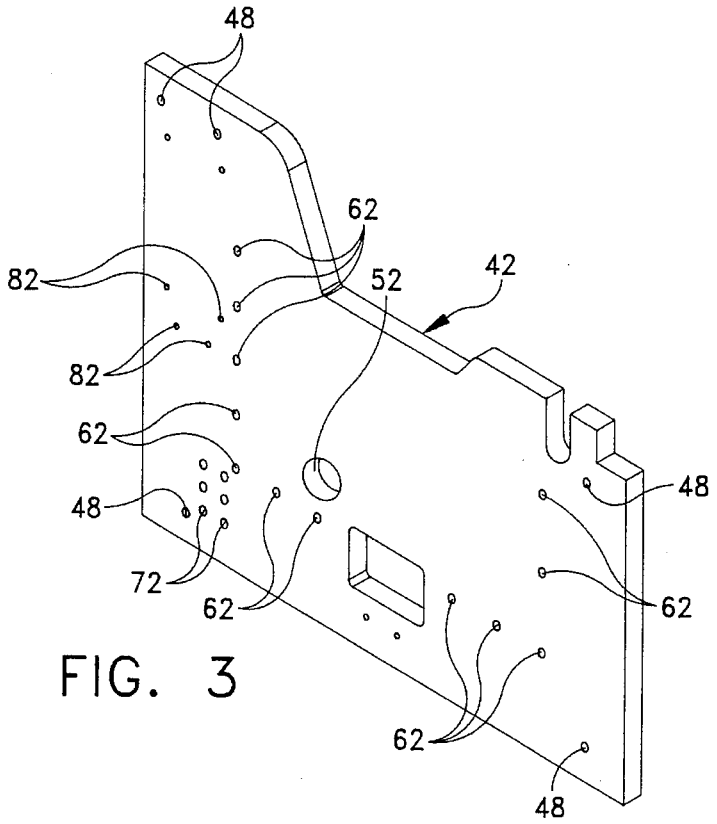
FIG. 3 is an perspective view of one of two side frame mounting plates of the conversion kit, the other mounting plate being substantially a mirror image thereof.
Figure 4:
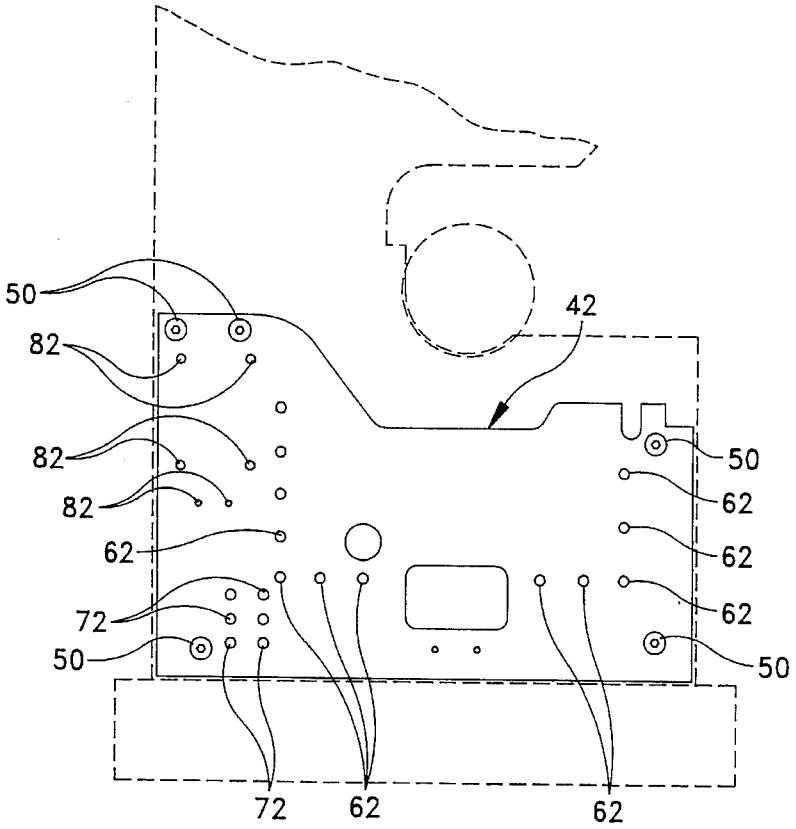
FIG. 4 is an elevational view of one of the side frame mounting plates illustrated in solid lines wherein the side frame of the printing unit and image carrier are illustrated in broken lines.

Turning now to FIGS. 3 and 4, the side frame mounting plates 40, 42 of the conversion kit 12 are adapted to mount directly onto respective inwardly facing surfaces of the side frames 14, 16 of the printing unit 10 so as to provide a clean mounting surface on which the new ink fountain 44 and adjustable doctor blade assembly 46 are mounted. The mounting plates 40, 42 are fabricated from machined steel which are cast to have a thickness of approximately one inch. It should also be pointed out that mounting plate 40 is a mirror image of mounting plate 42. Five clearance openings 48 are formed in the mounting plates 40, 42 for receiving machine bolt fasteners 50 therethrough which are used for mounting the mounting plates 40, 42 onto their respective side frames 14, 16. The inwardly facing surfaces of the side frames 14, 16 must be machined with tapped bores (not shown) which receive the bolt fasteners 50, the tapped bores being in registry with the clearance openings 48 of the mounting plates 40, 42.

As shown throughout FIGS. 2–7, the mounting plates 40, 42 are uniquely-shaped so as to mount on their respective side frames 14, 16 without interfering with the other equipment of the printing unit 10, such as structural members (not shown) which interconnect the side frames, ink guards located above the new ink fountain 44 and adjustable doctor blade assembly 46, and other related equipment. One feature of note is that a large circular opening 52 is formed each mounting plate 40, 42, the opening 52 being sized for receiving therethrough an ink drain (not shown) of the printing unit 10 which removes excess ink from the ink fountain 44.

Figure 2:
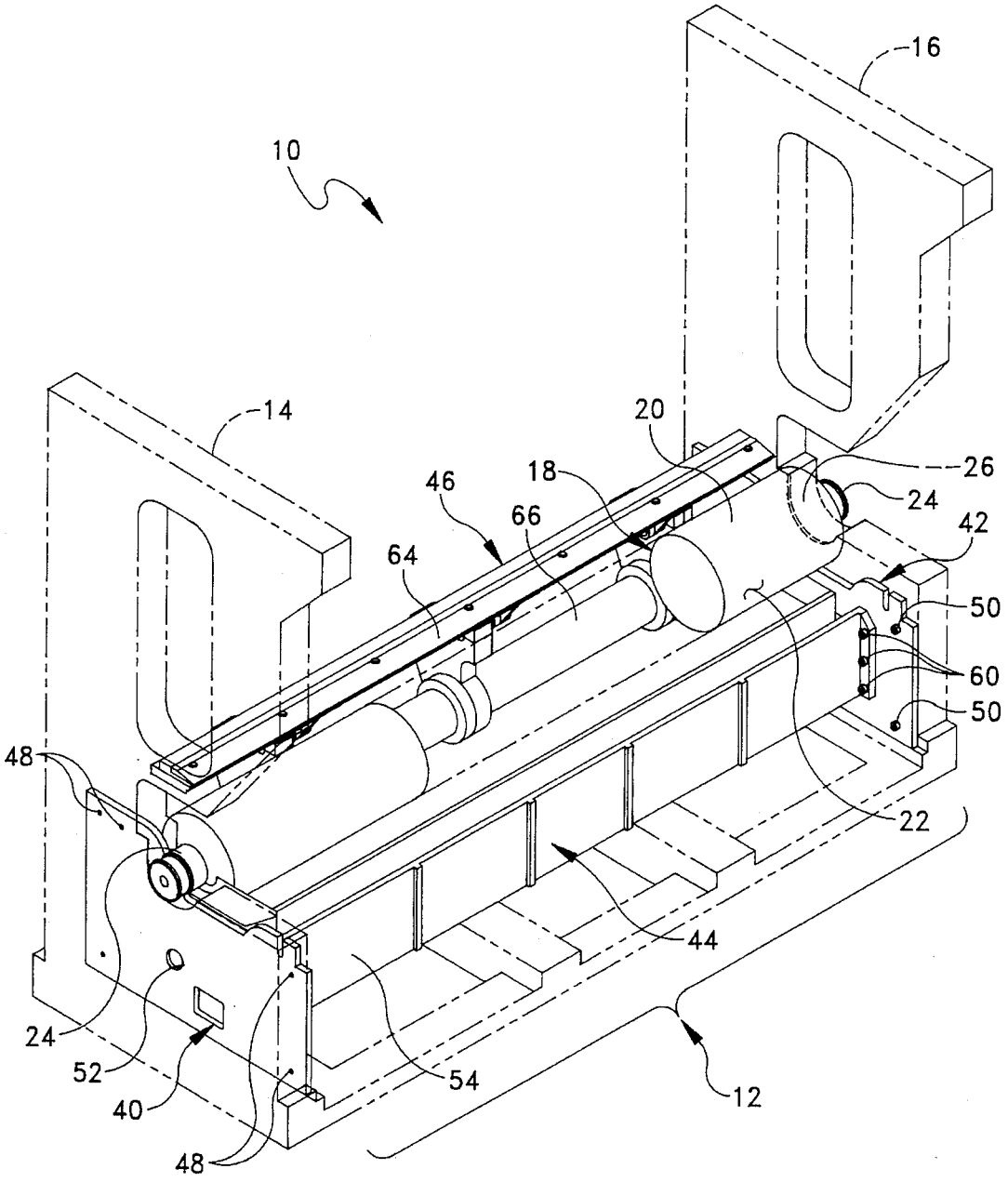
FIG. 2 is a perspective view of the printing unit after it is retro-fitted with a conversion kit of the present invention for converting the stationary doctor blade assembly with an adjustable doctor blade assembly and the ink fountain with a new, modernized ink fountain.

Turning to FIGS. 2 and 6, there is illustrated the new ink fountain 44 comprising an ink well 54 which is positioned beneath the cylinder body 20 of the image carrier 18, along with means for depositing the ink on the cylinder body in the form of a sock roll 56. The ink fountain 44 has at each end of the ink well 54 an outwardly extending flange 58 which mates against their respective mounting plate 40 or 42 of the conversion kit 12, each flange 58 having a plurality of clearance openings (not designated) formed therein for receiving machine bolt fasteners 60 which mount the ink well 54 on the mounting plates 40, 42. As shown in FIG. 6, the flange 58 extends outwardly from three sides of the ink well 54 on each end thereof wherein there are twelve clearance openings formed therein for receiving the machine bolt fasteners 60. Each mounting plate 40, 42 has tapped openings 62 formed therein that are in registry with the openings of the respective flange 58 of the ink well 54. These tapped openings 62 threadably receive the threaded portions of the machine bolt fasteners 60 to mount the ink well 54 on the mounting plates 40, 42.

Referring to FIG. 6, the sock roll 56 is suitably mounted for rotation on the ink well 54 where it is supported in a position to engage the cylinder body 20 of the image carrier 18. The sock roll 56 is designed to move towards and away from the cylinder body, and have a sufficient range of motion so as to accommodate small and large diameter cylinder bodies 20 (e.g., diameters between thirty and sixty inches). The arrangement is such that the cylinder body 20 of the image carrier 18 is bathed within ink provided in the ink well 54, and when the cylinder body 20 rotates, the sock roll 56 evens out the ink in a manner well-known in the art.

Figure 5:
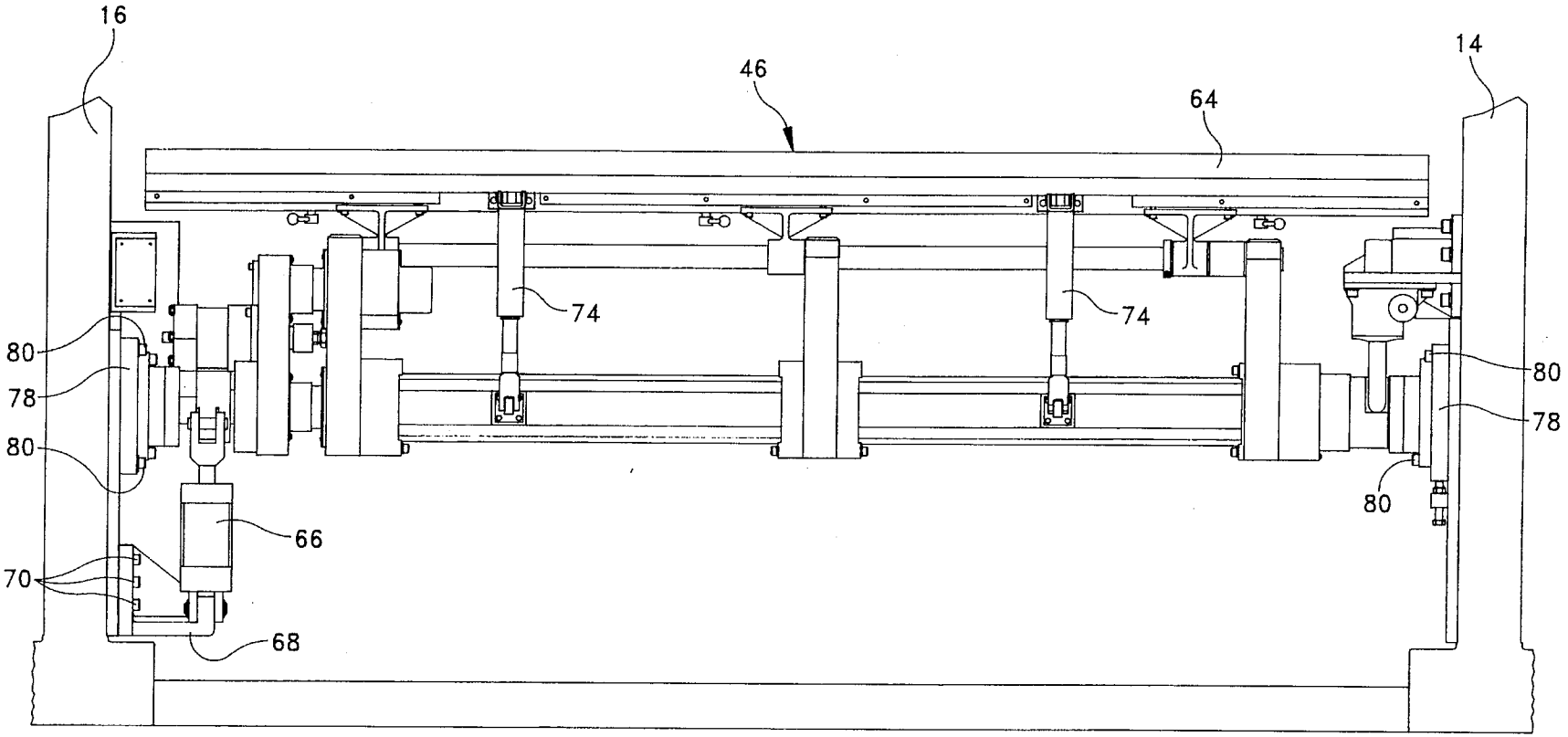
FIG. 5 is a partial rear elevational view of the printing unit illustrated in FIG. 2.
Figure 7:
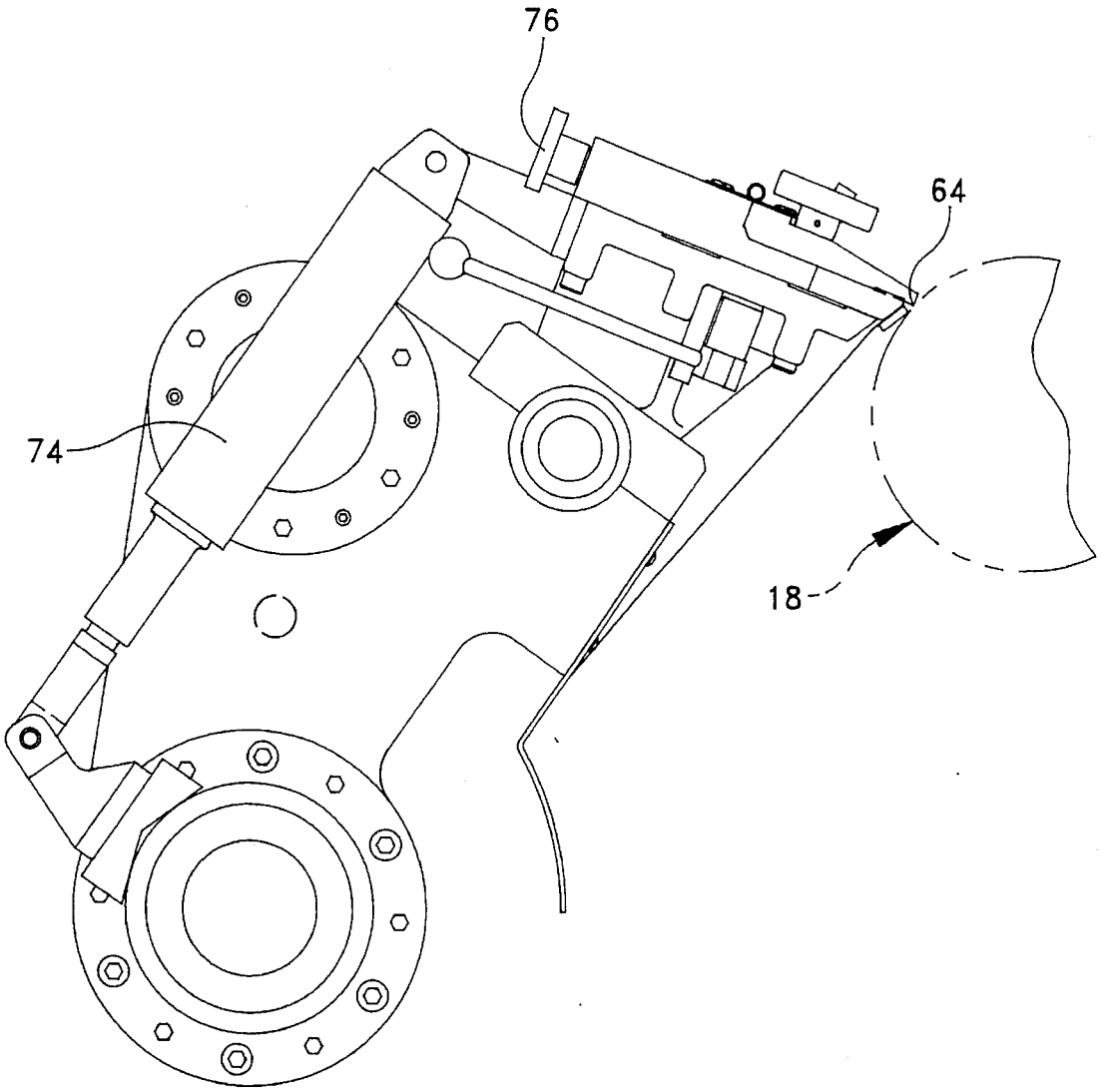
FIG. 7 is an enlarged end view of the adjustable doctor blade assembly of the conversion kit.

Referring now to FIGS. 5–7, the adjustable doctor blade assembly 46 comprises a doctor blade 64 which is capable of engaging the cylinder body 20 of the image carrier 18 for wiping the body 20 of excess ink, and means embodying a lower actuating device 66 for moving the doctor blade 64 towards and away from the cylinder body 20. The adjustable doctor blade assembly 46 is particularly designed to accommodate cylinder bodies having varying diameters (and circumferences). The lower actuating device 66 comprises a piston and cylinder arrangement for pivotally moving the doctor blade 64 towards and away from the cylinder body 20. As illustrated in FIG. 5, an L-shaped mounting bracket 68 attaches the lower actuating device to the mounting plate 42 which is mounted on the left-hand side frame 16. This mounting bracket 68 is secured to the mounting plate 42 by several machine bolt fasteners 70 which extend through clearance openings formed in the mounting bracket (not shown) and into tapped openings 72 formed in the mounting plate 42.

The adjustable doctor blade assembly 46 also includes an upper actuating device 74 for further adjusting the doctor blade 64 in the manner well-known in the art of gravure printing units. FIG. 7 illustrates one of two such upper actuating devices 74, it comprising a piston and cylinder arrangement which operates to adjust the doctor blade 64 so that one side of the doctor blade 64 firmly engages the cylinder body 20 while the other side engages it at a lesser degree, and vice versa. This arrangement is to prevent excess wear from occurring to either the doctor blade 64 or the cylinder body 20, and to extend the life of these component parts. Suitable thumb turn members 76 are further provided for achieving minor adjustments of the doctor blade 64 against the cylinder body 20 (see FIGS. 6 and 7). It should be noted that the doctor blade assembly 46 comprises other component parts which support the upper actuating device 66 and the doctor blade 64; however, these parts are well-known in the art and any further description thereof is unnecessary.

As illustrated in FIG. 6, for each side of the adjustable doctor blade assembly 46, another mounting bracket 78 mounts the upper actuating device 74, which carries the doctor blade 64, to its respective mounting plate 40, 42. More specifically, each mounting bracket 78 includes four clearance openings (not shown) which receive machine bolt fasteners 80 therethrough for securing the mounting bracket 78 to its respective mounting plate 40 or 42. Tapped openings 82 (see FIG. 4) are formed in each mounting plate 40 and 42 in a pattern in registry with the clearance openings of its respective mounting bracket 78 for threadably receiving the threaded portions of the machine bolt fasteners 80. The component parts of the upper actuating device 74 are suitably mounted by fasteners on the mounting bracket 78.

It should be noted that the mounting plates 40, 42 of the present invention provide a clean surface on which the new ink fountain 44 and adjustable doctor blade assembly 46 are mounted. Heretofore, older printing units could not easily receive retro-fit kits which were designed to update the printing units. This is due to the excessive amount of tapped openings and other machined formations which were left behind in the side frames 14, 16 after the existing ink fountain 30 and doctor blade assembly 36 were removed. The mounting plates 40, 42 of the conversion kit 12 of the present invention solves this problem by providing the necessary clean, unobstructed surface area required to mount the new ink fountain 44 and adjustable doctor blade assembly 46 thereon.

When converting a printing unit, such as unit 10 of FIG. 1, the existing ink fountain 30 (including the ink well 32) and the doctor blade assembly 36 must first be removed. It should be pointed out that any other part or accessory occupying the surface area that the mounting plates 40, 42 occupy on the side frames 14, 16 must also be removed. Next, the inwardly facing surfaces of the side frames 14, 16 are cleaned and the tapped bores which threadably receive the machine bolt fasteners 50 for securing their respective mounting plates 40, 42 are formed therein. The mounting plates 40, 42 are then mounted on their respective side frames 14, 16, the mounting plates 40, 42 being prefabricated with the necessary tapped openings 62, 72 and 82 for receiving the machine bolt fasteners 60, 70 and 80, respectively, required to secure the new ink fountain 44 and adjustable doctor blade assembly 46 to the mounting plates 40, 42.

The ink well 54 of the new ink fountain 44 is mounted on the mounting plates 40, 42 by means of machine bolt fasteners 60 which extend through the clearance openings formed in the flanges 58 of the ink well 54 and are threadably received within the threaded openings 62 of the mounting plates. Next, the brackets 68, 78 of the adjustable doctor blade assembly 46 are mounted on the mounting plates 40, 42 in a similar manner. Once mounted thereon, the other component parts of the assembly 46, e.g., the lower and upper actuating devices 66, 74 and doctor blade 64, can be assembled and attached to the brackets 68, 78. It should be noted that during the aforementioned installing of the conversion kit 12, the image carrier 18 is removed from the side frames 14, 16 and the impression roller 28 is moved to its highest position. It should also be noted that there may be occasions to replace the impression roller 28 because it is incapable of accommodating large-diameter cylinder bodies; however, such occasions are very seldom. Next, any other accessory, such as ink guards, are secured to the mounting plates 40, 42, and the necessary motor and power connections are made.

It should be pointed out that the novelty of the present invention lies not in the specific construction of the new ink fountain 44 and the adjustable doctor blade assembly 46 since these items are well-known and are constructed in accordance with the teachings presently available in the art. The present invention is directed to the provision of the two side frame mounting plates 40, 42 which enables the printing unit 10 to receive and mount on its existing side frames 14, 16 the new ink fountain 44 and the adjustable doctor blade assembly 46. Thus, it is observed that an older printing unit can be updated and modernized relatively easily with the conversion kit 12 of the present invention.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A conversion kit for converting a doctor blade assembly and an ink fountain of a printing unit, said printing unit being of the type for depositing ink on a substrate, such as a web of paper, and comprising a pair of spaced apart side frames, an image carrier having a cylinder engraved with the image to be printed on the substrate, said cylinder being removably and rotatably mounted on said side frames, an ink fountain having an ink well positioned beneath the cylinder and means for depositing ink on the cylinder, said ink fountain being supported by said side frames, a doctor blade assembly mounted on said side frames and having a blade which wipes excess ink from non-image areas of the cylinder, said doctor blade assembly being stationary and/or having a limited range of motion, and an impression roller which holds the substrate to be printed against the cylinder to obtain ink transfer, said impression roller being rotatably mounted on said side frames, said conversion kit comprising:

a pair of side frame mounting plates, one for each side frame, said mounting plates being mounted on the inwardly facing surfaces of their respective side frames after said cylinder, ink fountain, and doctor blade assembly are removed therefrom;

a new ink fountain having an ink well positioned beneath the cylinder and means for depositing ink on the cylinder, said ink fountain being mounted on and supported by the mounting plates; and an adjustable doctor blade assembly mounted on the mounting plates, said adjustable doctor blade assembly having a doctor blade, and means for moving the doctor blade towards and away from the cylinder, the arrangement being such that by virtue of the adjustability of the doctor blade, the side frames of the printing unit can receive cylinders having various circumferences, wherein the new ink fountain and adjustable doctor blade assembly are mounted directly on said pair of side frame mounting plates and function as a self-contained unit.

2. A conversion kit as set forth in claim 1 further comprising means for fastening said adjustable doctor blade assembly to said side frame mounting plates.

3. A conversion kit as set forth in claim 2, said side frame mounting plates each being fabricated from machined steel and being mounted on respective side frames by bolt fasteners.

4. A conversion kit as set forth in claim 3, said fastening means for fastening said adjustable doctor blade assembly to said mounting plates comprising a plurality of doctor blade assembly mounting brackets.

5. A conversion kit as set forth in claim 4, said brackets being fastened to said mounting plates by a plurality of bolt fasteners which are received in tapped openings formed in the mounting plates.

6. A conversion kit as set forth in claim 5, said adjustable doctor blade assembly further comprising an upper actuating device for adjusting the pressure of the doctor blade against the cylinder, and a lower actuating device for adjusting the doctor blade angle, said upper and lower actuating devices being mounted on said mounting plates by said brackets and bolt fasteners.

7. A conversion kit as set forth in claim 1 further comprising means for fastening said ink well to said side frame mounting plates.

8. A conversion kit as set forth in claim 7, said fastening means comprising bolt fasteners.

9. A conversion kit as set forth in claim 8, said ink fountain further comprising a sock roll which is mounted on and supported by said ink well.

* * * * *